United States Patent [19]

Andreassen

[11] 4,123,479

[45] Oct. 31, 1978

[54] CARBURETOR CONTROLLED BY A SLIDING MOVEMENT

[76] Inventor: Anders O. Andreassen, Alphyddevägen 21, S-131 00 Nacka, Sweden

[21] Appl. No.: 762,785

[22] Filed: Jan. 25, 1977

[30] Foreign Application Priority Data

Jan. 28, 1976 [SE] Sweden ..... 7600870
Nov. 1, 1976 [SE] Sweden ..... 7612117

[51] Int. Cl.[2] ..... F02M 9/06

[52] U.S. Cl. ..... 261/44 B; 261/DIG. 2; 261/DIG. 38; 261/34 A; 137/607

[58] Field of Search ..... 261/44 R, DIG. 38, DIG. 2, 261/41 B, 41 C, 34 A; 137/607

[56] References Cited

U.S. PATENT DOCUMENTS

| | | | |
|---|---|---|---|
| 1,103,802 | 7/1914 | Meissner | 261/39 A |
| 1,190,125 | 7/1916 | Lukacsevics | 261/44 R |
| 1,375,898 | 4/1921 | Ciglia et al. | 261/DIG. 38 |
| 2,574,670 | 11/1951 | Sweeney | 261/50 A |
| 3,246,886 | 4/1966 | Goodyear et al. | 261/44 R |
| 3,273,869 | 9/1966 | Morton | 261/50 A |
| 3,547,415 | 12/1970 | Perry | 261/DIG. 2 |
| 3,709,469 | 1/1973 | Carter et al. | 261/44 R |
| 3,822,058 | 7/1974 | Carter | 261/44 R |
| 3,893,436 | 7/1975 | Beekhuis, Jr. | 261/44 R |
| 3,957,930 | 5/1976 | Birmingham | 261/44 R |
| 3,985,839 | 10/1976 | Edmonston | 261/44 R |
| 4,001,355 | 1/1977 | Day | 261/DIG. 2 |

FOREIGN PATENT DOCUMENTS

| | | | |
|---|---|---|---|
| 849,319 | 9/1952 | Fed. Rep. of Germany | 261/44 R |
| 187,891 | 11/1922 | United Kingdom | 261/44 R |
| 1,278,292 | 6/1972 | United Kingdom | 261/44 R |

*Primary Examiner*—Tim R. Miles
*Attorney, Agent, or Firm*—Finnegan, Henderson, Farabow & Garrett

[57] ABSTRACT

A carburetor of the type admitting simultaneous control of both air and fuel supply. The air supply is regulated by means of a linearly movable aperture means, whereas the fuel supply is regulated by means of a linearly movable rod means provided with groove means having a transverse profile of monotonically varying area. A selectable portion of said groove means can be coupled into a fuel conduit, thus regulating its effective size and thereby the fuel supply by means of a linear movement of said rod means. Said rod means and said aperture means are coupled for mutually proportional linear movement, thus accomplishing the simultaneous control. By appropriate manufacturing of the groove means it is possible to obtain improved fuel-to-air ratio for settings between idling and full gas. The rod means also works as a plunger in a cylinder, thereby rendering an accelerator pump function.

9 Claims, 17 Drawing Figures

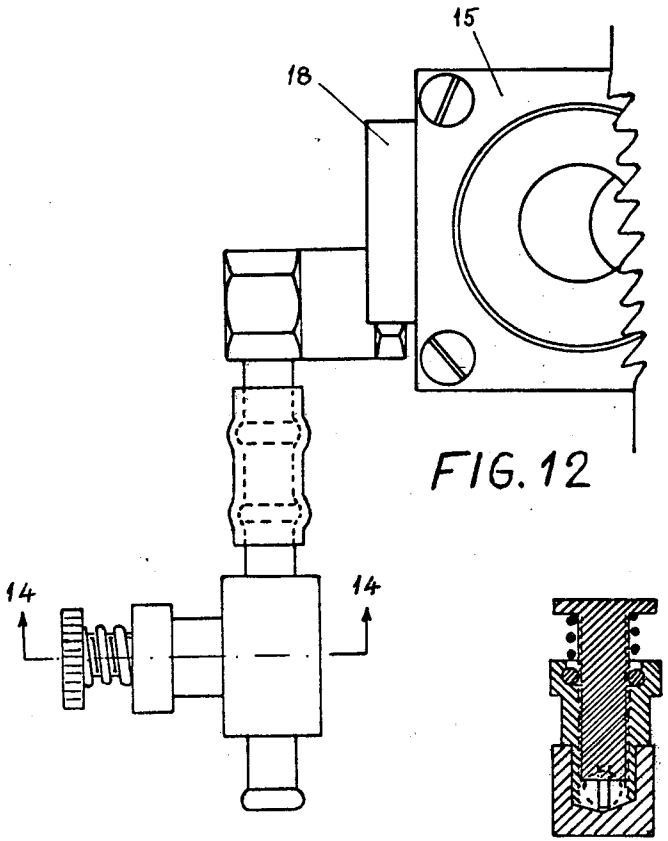
FIG. 12
FIG. 14.
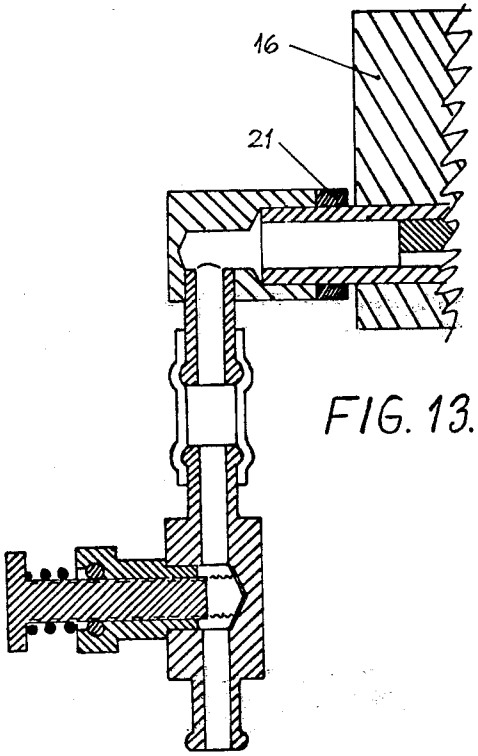
FIG. 13.

CARBURETOR CONTROLLED BY A SLIDING MOVEMENT

BACKGROUND OF THE INVENTION

The present invention relates to a carburetor for combustion engines. The invention was developed in connection with work on one-cylinder model plane engines, but it is obvious that the invention can also be used in many other types of engines. For example, an obvious application is to use a carburetor in accordance with the invention in motorbike and motorcycle engines.

The carburetor according to the invention is of the type in which the supply of fuel and combustion air are controlled simultaneously. Carburetors of this type are previously known and are widely used. An example of a conventional carburetor of this type is disclosed in U.S. Pat. No. 3,456,929, which discloses the conventional technology. As regards engines for model airplanes, it can be mentioned that in model plane carburetors a conventional needle valve is coupled to control means for the combustion air.

One object of the present invention is to achieve a carburetor which is simple to produce and is capable of simultaneously controlling both the fuel and the air supply through two coupled devices. Another object of the invention is to achieve a carburetor which is much more reliable than those presently on the market.

An additional purpose of the invention is to achieve a carburetor for simultaneous control of fuel and air supply, in which it is possible to more carefully adjust the supply of fuel and air to one another in the interval between the idling and wide open positions.

SUMMARY OF THE INVENTION

These and other goals and advantages, which will be evident from the following description, are achieved according to the invention by a carburetor controlled by a sliding movement, which has the characteristics disclosed in the appended claims.

In general and without thereby restricting the scope of the invention the present carburetor can be described schematically as follows. The air supply control is achieved by an aperture disposed transversely to a Venturi tube and which can be moved to change its size. The control of the fuel supply is done by displacement of a plunger rod which is provided with a longitudinal groove, a selectable portion of which is included in the fuel path. Since the groove is made so that its depth varies along the length of the plunger rod, the displacement of the plunger rod produces a variable throttling of the fuel path. The plunger rod and the aperture can be moved parallel to one another and are also jointed for unified movement, providing a coupled control of the air supply and the fuel supply. By working on a cylinder space, the plunger rod also has an accelerator pump function.

Analogous mechanical ways of coupling are of course possible and the man skilled in the art will readily see, for example, that it would work just as well if the two means were articulated at different attachment points on a lever. The movements would then be proportional but not equal. Many other types of mechanical coupling are obvious to the man skilled in the art.

What is meant by the term "Venturi tube," in the present description, is the inlet tube for combustion air, into which fuel is dispersed. Normally such pipes are provided with a diminished cross-sectional area in the middle, but since a great number of the advantages of the invention would be achieved with many other pipe shapes, it is intended that the term should also encompass such shapes.

Saying that the depth of the groove varies "monotonically" along its length means, according to conventional mathematical terminology, that for two arbitrary points the second point lying in the direction of greater groove depths from the first point, that the groove at the second point will always have a depth greater than or equal to the depth at the first point. Since the groove has limited length, it is apparent that the groove can only maintain this characteristic as far as to the deepest point where the monotonity of the groove must end.

BRIEF DESCRIPTION OF THE DRAWINGS

The invention will now be described in connection with the drawings of the embodiments.

FIG. 12 shows a part of an alternative embodiment.

FIG. 13 shows the part in FIG. 12 in section.

FIG. 14 shows a fuel cock in the wide open position in section along the line 14—14 in FIG. 12.

DETAILED DESCRIPTION OF PREFERRED EMBODIMENTS

Figure 1:
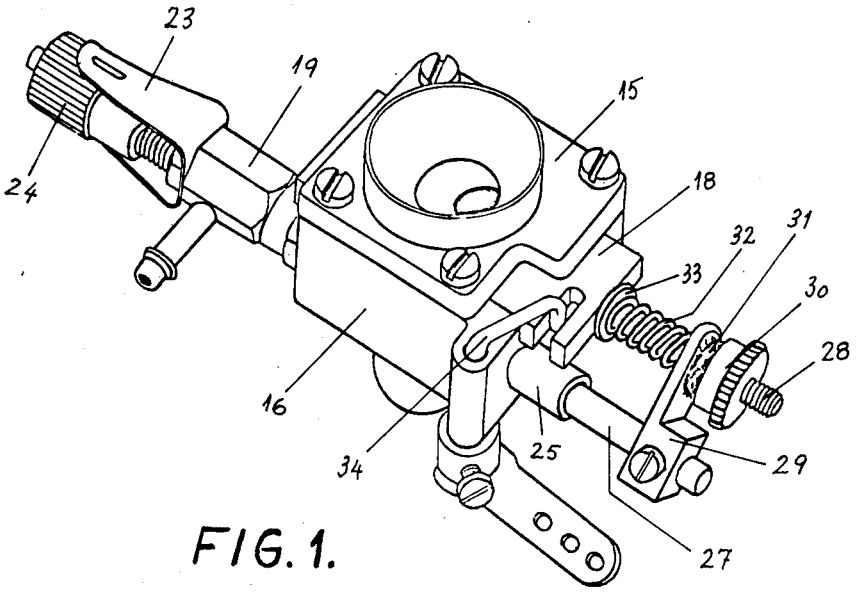
FIG. 1 shows a perspective view of a carburetor according to the invention.
Figure 1A:
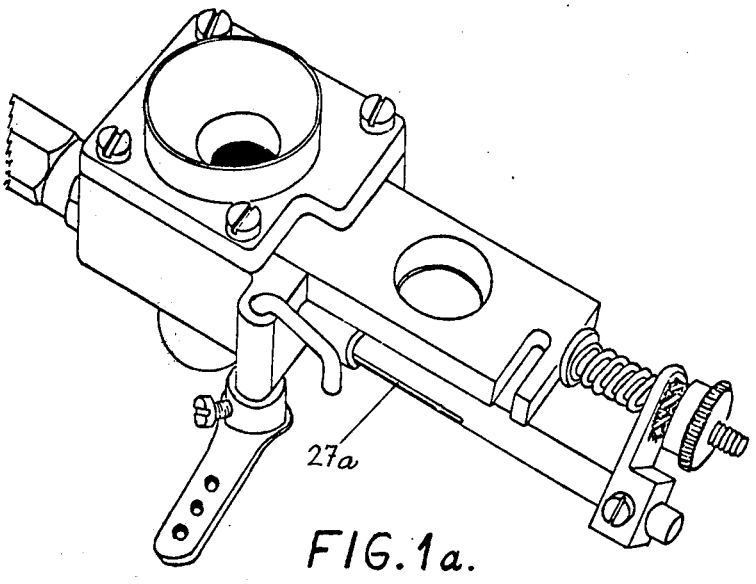
FIG. 1*a* shows the carburetor in FIG. 1 with the control means partially drawn out.

A preferred embodiment of the invention will now be described with reference to FIGS. 1–10. A Venturi tube 17 is included in the carburetor, which is provided with a movable aperture means 18 including a member having an aperture which can throttle the air supply through the Venturi tube. The carburetor is intended to be mounted on a combustion engine, and the downwardly directed end of the Venturi tube 17 according to FIG. 3 is connected to the engine. The opposite end of the Venturi tube is for intake of air and can be provided with any required air-cleaning devices.

The aperture means 18 is controllably coupled via a connecting piece 29 to a plunger rod 27 which is disposed to move in the elongated opening of a cylinder liner device 25 disposed in the housing 16. The plunger rod 27 and the aperture means 18 are arranged so that they can be moved parallelly in the carburetor. The aperture means is fitted into a groove in the housing which is closed by an air-intake piece 15 (which can be made of a fuel and heat resistant plastic material) attached, by screws for example, to the housing 16.

Figure 11:
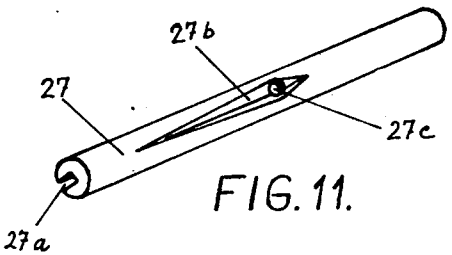
FIG. 11 shows a plunger rod for fuel control.
Figure 10:
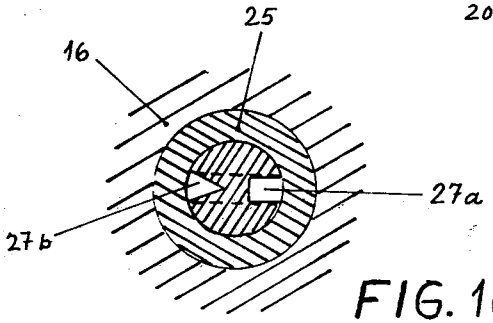
FIG. 10 shows a section along the line 10—10 in FIG. 9.

As is seen best in FIG. 11, the plunger rod is provided with a longitudinal groove 27*a*, an opposite, longitudinal groove 27*b* whose depth varies along the plunger rod, and a hole 27*c* connecting the two grooves. As is shown best in FIG. 9 the fuel is taken in via a pipe 20 and a needle valve 24 for adjusting the full-gas mixture ratio, which has a control needle 24*a* disposed in a tube 19, into the interior of the cylinder liner and continues thereafter through the groove 27*a* and the hole 27*c* to the groove 27*b*. As is evident from FIGS. 6 and 9, the cylinder liner is arranged so that its outer surface intersects the inner surface of the Venturi tube. In drilling the Venturi tube the appropriate parts of the cylinder liner 25 are removed. (This is of course made in the absence of the plunger rod 27.) The groove 27*b* thus opens into the Venturi tube 17. As is evident from FIG. 9, moving the plunger rod 27 to the right in the figure results in increased throttling of the supply of fuel.

Figure 2:
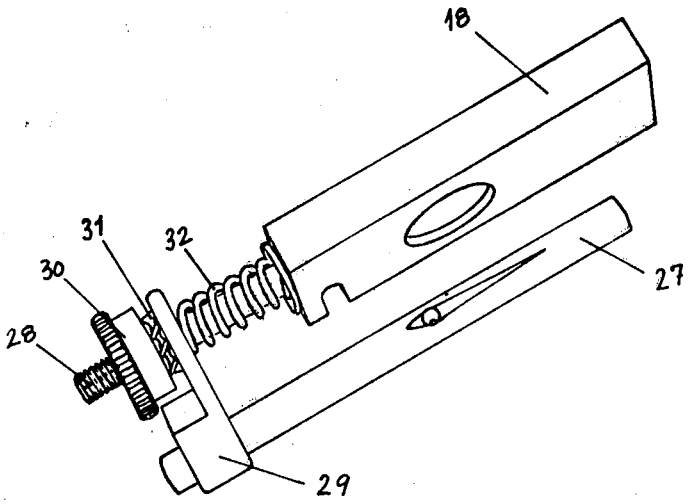
FIG. 2 shows the drawn-out control means for the carburetor in FIG. 1.
Figure 3:
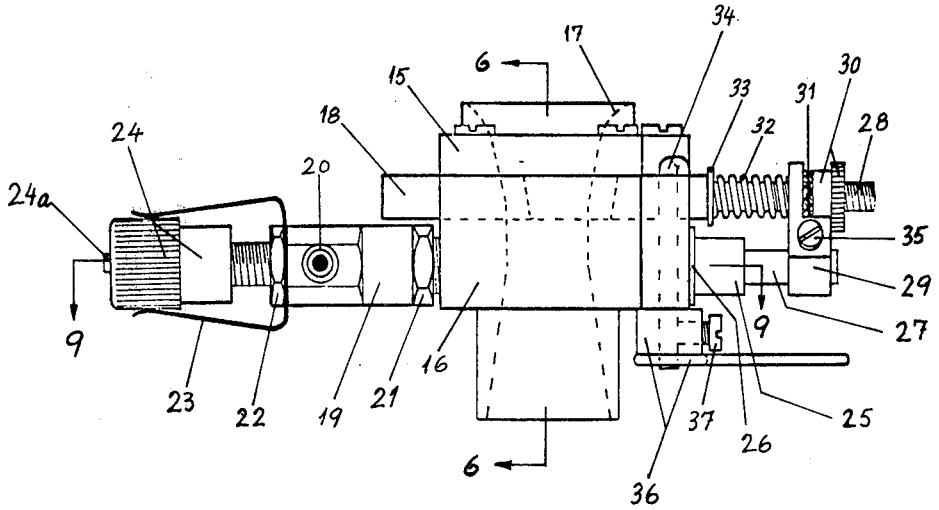
FIG. 3 shows the carburetor in FIG. 1 as seen from above.
Figure 4:
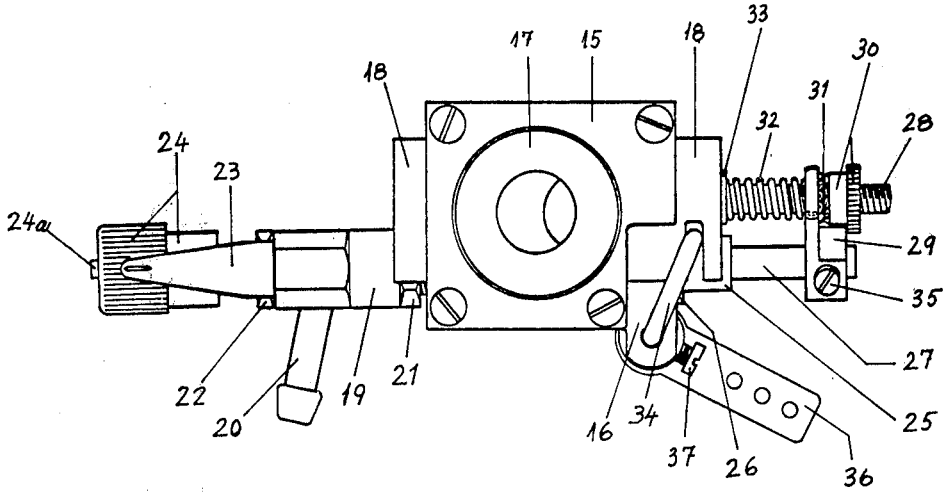
FIG. 4 is a frontal view of the carburetor in FIG. 1.
Figure 5:
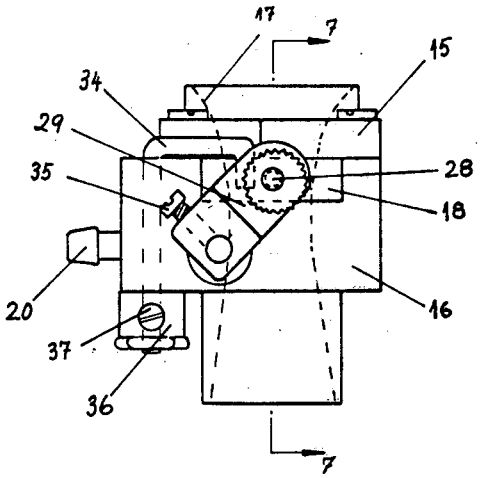
FIG. 5 shows the carburetor in FIG. 1 as seen from the side.
Figure 6:
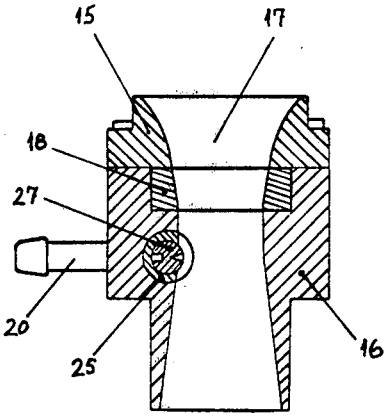
FIG. 6 shows a section along the line 6—6 in FIG. 3.

As is most clearly shown in FIG. 2, the plunger rod and the aperture means are joined together via a connecting piece 29. For setting the idle, the plunger rod 27 and the aperture means 18 can be moved in relation to one another by turning a nut 30 which is screwed onto a threaded portion 28. A spring 32, the connection piece 29, a lock washer 31 and the nut 30 are placed on the threaded portion 28 in that order.

As is evident from FIG. 1, the aperture 18 with the attached plunger rod 27 is arranged in the carburetor in such a way that it can be moved by means of a swingable operating arm 34 which engages a slot in the aperture means 18. The arm can be provided with suitable means for turning it, as for example in FIG. 1.

Figure 9:
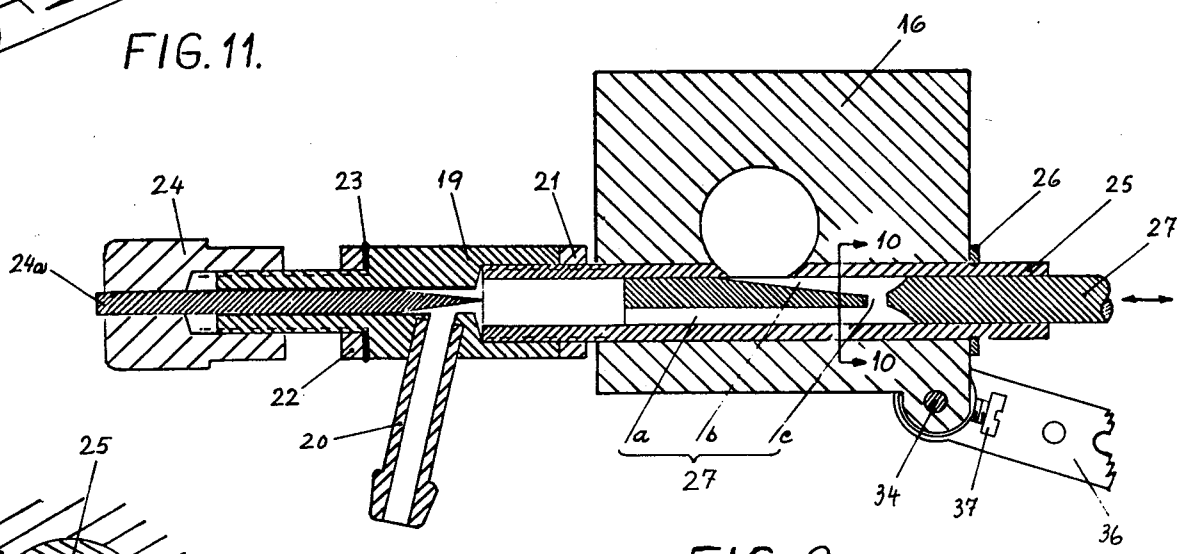
FIG. 9 shows the fuel control in longitudinal section.

The needle valve previously mentioned is, as is evident from FIG. 9, arranged in an extension of the cylinder liner 25. A valve seat 19 is screwed onto the protruding end of the main body 16 of the carburetor. By insertion of the needle 24*a* to a greater or lesser degree the supply of fuel through the pipe 20 can be throttled. The valve seat piece 19 has a thread onto which a knurled, internally threaded adjustment knob 24 is screwed. The needle 24*a* is mounted in the center line of this knob. So that the control of the needle valve will not be affected by vibration, spring metal tongues 23 are arranged to engage the knurled portion.

One will notice in FIG. 9 that there is a special space in the fuel path between the needle valve 24 throttling and the plunger rod 27. This space interacts with the plunger rod 27 such that when the plunger rod is rapidly pushed in, there will be an increase in pressure since the flow resistance through the needle valve is high. This will produce a special accelerator pump effect which is very advantageous.

FIGS. 12, 13 and 14 show an embodiment in which the needle valve arranged in the extension of the cylinder liner has been replaced with a valve at a distance from the actual carburetor. In model engines this has the advantage that the valve can be placed sufficiently far away from the propeller of the model airplane engine so that finger injuries will be avoided. In the embodiment shown in FIGS. 12–14 the adjustment means consists of a threaded screw whose length is perpendicular to the direction of the fuel line. The screw is threaded in a tube which is joined, by soldering for example, to the fuel line. The threaded tube is provided in its innermost portion with two open slots arranged on one diameter, and the slots are arranged so that said diameter coincides with the center of the fuel line. When the screw is screwed in, a greater and greater portion of the slots will be closed off by the screw, thereby making fuel flow control possible.

Figure 15:
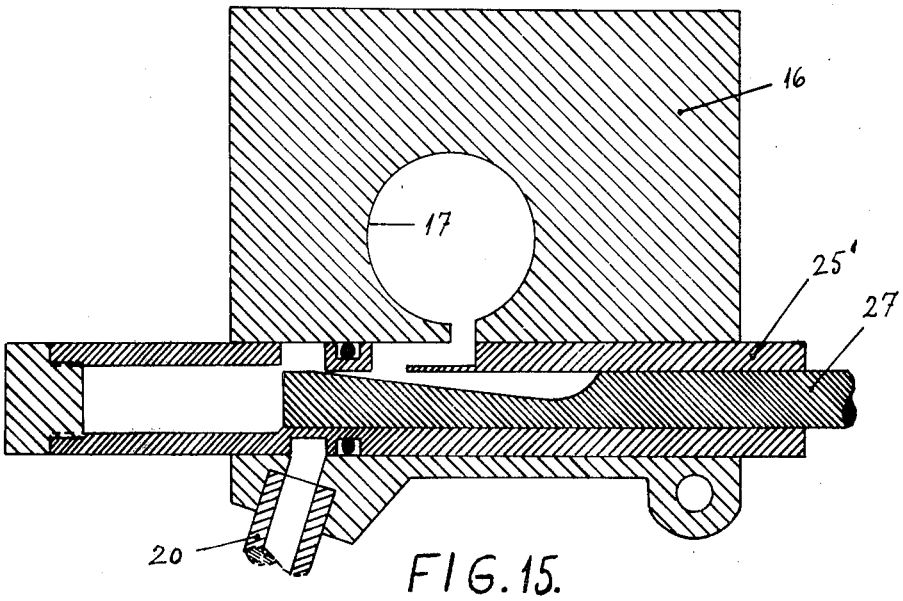
FIG. 15 shows an alternative embodiment of the carburetor.

FIG. 15 shows another embodiment of the fuel control according to the invention. The cylinder liner 25' is in this case closed at the end where, according to the first embodiment, the needle valve is placed. The fuel line 20 opens into an annular hole formed by an annular cut in the outside of the cylinder liner, which makes a space together with the hole in the main body 16 of the carburetor. The annular space is connected via a bore to the interior of the cylinder liner, the bore being arranged on the same side of the cylinder as the groove with varying depth in the plunger rod. In this case there is no groove 27*a* and hole 27*c*. A short distance away from said inlet for fuel to the groove in the plunger rod, there is an additional opening in the cylinder lining 25'. This provides the connection to the Venturi tube 17.

The first-described carburetor according to FIGS. 1–11 is the best mode of the invention known to the inventor. Compared to the previous version as shown in FIG. 15 a better acceleration pump effect is achieved since the throttling through the needle valve is so close to the plunger that the elasticity phenomena due to hoses and air bubbles can be minimized. Furthermore it is an advantage that the plunger rod with the groove 27*b* protrudes into the Venturi tube, since this will provide a blow cleaning effect. It can also be seen from FIG. 6 that the portion of the plunger rod protruding into the Venturi tube provides a type of air foil effect which will tend to resulting in a particularly effective dispersion and mixture of the fuel into the passing combustion air.

In a comparison with needle valves for adjusting the flow of fuel relative to the flow of air, the present invention has the following advantages. The needle in a fuel valve can easily become off center in relation to the valve seat against which it seals. Thus it will be very difficult, especially over long periods of time, to avoid wear at this sensitive point. In the carburetor according to the invention there is no wear on the groove whatsoever, and it is easy to obtain a cylinder liner and plunger rod which have good fit and wear resistance. Furthermore the principle of using a groove provides the possibility of adjusting the fuel air supplies to one another as desired by manufacturing the groove so as to achieve an optimum mixing ratio, so that the mixture will neither be too rich nor too lean.

Figure 16:
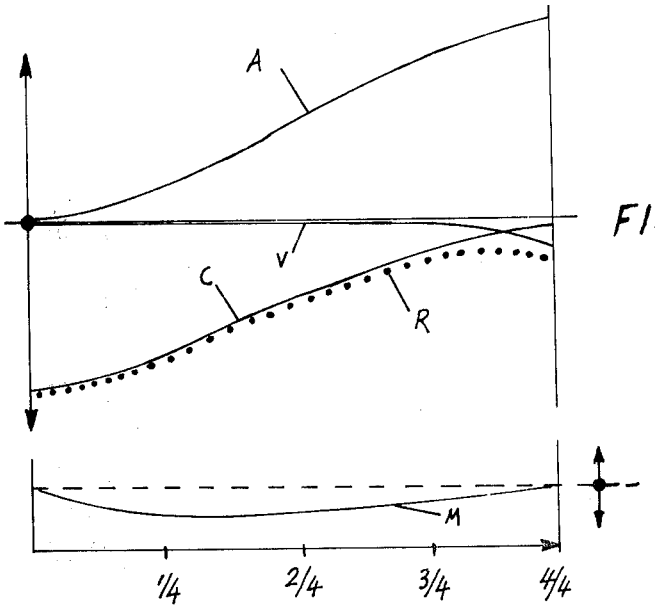
FIG. 16 is a diagram demonstrating an advantage of the invention.

FIG. 16 illustrates this relationship. The diagram relates to the relationships in a single cylinder two-stroke engine. For combustion of methanol in air the theoretical or stoicheiometric mixing ratio is 1:9.7. Due to various mixing and scavenging problems in practice operating conditions are not always the most favorable when using exactly this ratio, but it is evident that even small deviations from an optimum should be avoided as much as possible.

In FIG. 16 the air intake degree of opening is given along the X-axis. The uppermost curve A shows how the amount of air, which is drawn in, varies with the setting of the air intake. The middle of the diagram shows how the suction effect on the fuel system varies. The curve V shows the suction effect due to the Venturi effect. As one would expect, the Venturi effect is weak when the engine is running slowly, and increases rapidly as one approaches maximum r.p.m. A rather powerful suction effect is obtained from the engine crankcase. Its relationship to the r.p.m. or air intake setting is given with the solid line C. The two components are summed into a total sum given by the curve R which represents the total suction effect at the fuel opening in a Venturi tube in a carburetor as a function of r.p.m. or the air intake setting.

Normally a carburetor is adjusted by setting the idling mixture and the full speed mixture individually. When using an uncomplicated, coupled fuel and air control of the usual needle type, it is very difficult to compensate for the shape of the curve R in FIG. 16, and a varying mixture ratio according to the curve M is the usual result instead of according to the dashed straight optimal curve line. By adjusting the shape of the groove in the carburetor according to the invention, a great improvement can be achieved in this respect. Amongst other advantages one could mention that the Venturi tube in the wide open position is smooth and without blockages, so that the air resistance is reduced. It has been experimentally found that this together with other characteristics in a 10 $cm^3$ engine gives approximately 15% greater power than with a conventional carburetor.

The fuel control system is relatively insensitive to the fuel level, and therefore there is often no need for floater systems. Since it is also possible with the present construction to obtain good fits and seals, it is possible to use overpressure on the fuel. For engines intended for ground use an overpressure of approximately 100 mm water column is suggested, while model airplane engines, which during sharp maneuvers are subjected to acceleration on the order of 15–20 G, can be given an overpressure of about 300 mm water column. It is easiest and most appropriate to take this overpressure from the exhaust system.

Figure 7:
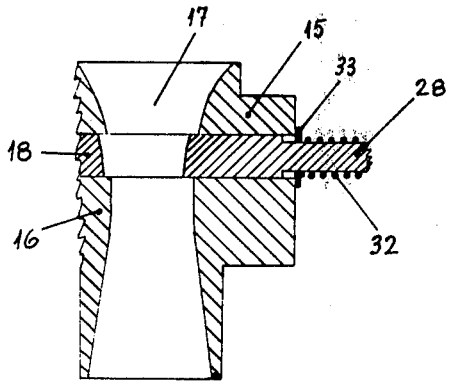
FIGS. 7 and 8 show a portion of the carburetor in section to demonstrate an advantageous feature.
Figure 8:
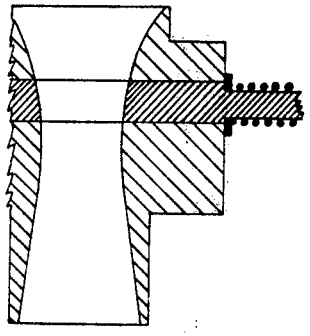

An advantageous feature is shown in FIGS. 7 and 8. If the spring 32, instead of engaging the aperture means 18 directly, engages a washer 33, it is possible after reaching the wide open position to continue the movement of the aperture means and the plunger rod a short distance. The amount of air will be reduced thereby, at the same time as the amount of fuel is increased. This can be advantageous if it is found that the fuel setting is slightly too lean in the wide open position. Stalling of the engine may thus be avoided when torque is high at low engine speed (overboost condition). Furthermore, for model airplane engines there is the advantage that the end position is not defined by the carburetor itself. The servo end position defined by the servo system can in general be reached. Thus one avoids the risk that the end position of the servo system would not be reached, and the engine of the servo system would be kept in the actuated state, thus draining the battery.

What I claim is:

1. A carburetor for a combustion engine comprising:

a housing having a venturi tube defining a flow passage, means for supplying air through said venturi tube including a member having an aperture in registration with said venturi tube and forming part of the flow passage through the venturi tube, said member being carried by said housing for translational movement whereby the size of the flow passage and consequent flow through said venturi tube is controlled in accordance with the translational position of said member relative to said venturi tube, means carried by said housing for supplying fuel through the carburetor and defining a fuel path including an elongated opening in said housing, means carried by said housing for controlling the flow of fuel through said fuel supply means including an elongated movable plunger in said opening having a longitudinally extending groove along its outer surface, at least a portion of said groove forming part of said fuel path and which groove extends monotonically in the direction of the longitudinal extent of said plunger, said plunger having a first end within said opening and defining a chamber therewith in said fuel path and which chamber decreases in volume in response to movement of said plunger inwardly of said housing, means coupling the opposite end of said plunger and said member one to the other for conjoint movement, said groove in said plunger having a cross section diminishing in the direction toward said first plunger end so that, when the fuel and air supply are increased by conjoint movement of said plunger and said member, the volume of said chamber decreases to cause an increase of fuel pressure with accompanying richer fuel mixture.

2. A carburetor according to claim 1 including means for displacing said plunger and said member relative to one another for adjusting the fuel supply when the engine is idling.

3. A carburetor according to claim 1 including a gas valve disposed in said fuel path for throttling the flow of gas therethrough.

4. A carburetor according to claim 1 wherein said opening is defined by a cylindrical sleeve which intersects the inner surface of said venturi tube, a portion of said plunger defined by the intersection between the geometric cylindrical surface of the sleeve and the geometric surface of said venturi tube being located inside said venturi tube, said groove facing the cavity of said venturi tube so that said fuel path opens into said venturi tube from the groove.

5. A carburetor according to claim 4 wherein said plunger has a second longitudinally extending groove, said second groove being arranged along a generatrix of said plunger other than the first mentioned groove and in such a manner that the second groove is outside the geometric surface of said venturi tube, and means forming a part of said fuel path and providing communication between said grooves.

6. A carburetor according to claim 5 wherein said second groove opens at one end in said chamber.

7. A carburetor according to claim 6 including a needle valve disposed in said fuel path, said needle valve opening into said chamber.

8. A carburetor comprising a body defining a venturi tube having an axis, a slide valve carried by said body and movable in a direction generally transverse to the axis of said venturi tube, said slide valve having an opening and being slidable in said transverse direction to restrict said venturi tube proportionally to the position of said opening relative to said axis, fuel measuring means including a cylinder in said body and a rod slidably disposed in said cylinder, said cylinder being disposed generally parallel to said transverse direction, said rod having a groove with a profile, the section of said profile transverse the rod being monotonously increased along the rod, means for joining said rod and said sliding means for unitary movement in said transverse direction, a fuel inlet for said carburetor, said cylinder forming with said rod an enclosed cylindrical chamber in communication with said groove and said fuel inlet, said profile being disposed with its smaller section pointing toward said cylindrical chamber.

9. A carburetor according to claim 8 wherein said joining means includes means for adjusting the position of said rod and said slide means relative to one another.

* * * * *